United States Patent [19]

Robinson

[11] 4,192,136

[45] Mar. 11, 1980

[54] ADJUSTMENT OF READOUT MEMBERS IN A DIGITAL CLOCK

[75] Inventor: Ralph C. Robinson, Charlotte, N.C.

[73] Assignee: General Time Corporation, Thomaston, Conn.

[21] Appl. No.: 780,842

[22] Filed: Mar. 24, 1977

[51] Int. Cl.[2] ..... G04B 19/02

[52] U.S. Cl. ..... 368/222; 235/133 R; 235/139 R; 368/235

[58] Field of Search ..... 58/125 C, 126 E; 235/139 R, 133 R

[56] References Cited

U.S. PATENT DOCUMENTS

| | | | |
|---|---|---|---|
| 2,114,501 | 4/1938 | Oswald | 58/125 C |
| 2,459,107 | 1/1949 | Johnson | 58/125 C X |
| 2,623,697 | 12/1952 | Ericsson et al. | 235/139 R |
| 3,078,655 | 2/1963 | Hickly | 58/125 C X |
| 3,574,995 | 4/1971 | Turner | 58/125 C |
| 3,898,792 | 8/1975 | Insley et al. | 58/125 C X |

*Primary Examiner*—Ulysses Weldon

*Attorney, Agent, or Firm*—Pennie & Edmonds

[57] ABSTRACT

A digital readout apparatus includes a housing, a plurality of members providing, respectively, a presentation of units-of-minutes, tens-of-minutes, and hours, a shaft for supporting the members within the housing for movement in rotation imparted either by a timed or manual setting input to the member of lowest order. The digital readout apparatus also includes an endshake element received on the shaft between the hours member and the housing. The endshake element includes cam structure on a side surface which cooperates with cam structure similarly contoured on the housing thereby through selective rotational adjustment of the endshake element relative to the shaft, both the hours and tens-of-minutes members are moved axially along the shaft relative to the units-of-minutes member which is fixed to the shaft for varying clearance between the members. The apparatus also includes means for periodically drivingly connecting pairs of members whereby a member of lower order may drive the member of next higher order.

12 Claims, 5 Drawing Figures

ADJUSTMENT OF READOUT MEMBERS IN A DIGITAL CLOCK

BACKGROUND AND BRIEF DESCRIPTION OF THE INVENTION

The present invention is directed to apparatus having capability of a digital readout of time by a visual observation of indicia imprinted on or carried by a plurality of rotatable members which may be indexed to a viewing window.

Various forms and arrangements of drive mechanisms have been employed in apparatus of this type for purposes of a timed incremental advance of the rotatable members including units-of-minutes, tens-of-minutes, and hour members. Further, various structural configurations have been employed in the past to maintain these rotatable members in the position to which and from which they are moved by the drive mechanism.

The present invention is an improvement in apparatus of this type and further provides structure for maintaining an amount of clearance between the rotatable members. As may be apparent, ambient conditions of heat and cold will have a decided effect on the amount of clearance between the rotatable members, some amount of which without being insufficient or excessive should be maintained for proper operation of the readout device. Thus, an insufficient clearance would result in a binding of the rotatable members necessitating greater torque for movement, and on the other hand, excessive clearance possibly would result in a failure of the driving engagement of the drive mechanism to militate against a positive advancing operation.

The structure for maintaining a clearance between the rotatable members is denominated an endshake element which is received between the rotatable member of highest order and the housing in which the members are disposed. Particularly, the rotatable members are supported on a shaft and the rotatable member of lowest order is secured to the shaft. The endshake element, likewise received on the shaft, includes camming means on one side of a plate-like body, which camming means cooperate with like camming means on the housing in the region surrounding an aperture which receives and provides support for one end of the shaft. Both camming means are defined by a plurality of inclined surfaces and through rotation of the endshake element relative to the housing the inclined surfaces of the camming means ride one on the other thereby to relocate the endshake element axially in the housing. Varying degrees of clearance between the rotatable members may be derived, accordingly. And, the positioning of the endshake element may be maintained after adjustment by detent means. This structure will be described with greater particularity below. Likewise, the structure for a timed and a setting advance of the rotatable members will also be described. Briefly, however, the advancing mechanism comprises a plurality of pinions supported for rotation adjacent the rotatable members, there being an input drive to each respective pinion while that pinion drives the rotatable member of next higher order. The pinions are freely mounted on a supporting shaft and are in engagement directly with the teeth of a continuous gear carried by a rotatable member of higher order, while in engagement intermittently with the teeth of a mutiliated gear carried either by a rotatable member of lower order or the timed advance mechanism constituting the input drive depending upon which pair of rotatable members are being considered. For this purpose, a plurality of the pinion teeth at equidistant spacing therearound are extended axially to span the gap between a pair of rotatable members or the timed advance mechanism, as the case may be. Thus, each pinion is jogged in advance as the mutilated gear moves into engagement with the axial extension of one of the teeth of the pinion which causes a similar advance through engagement with the continuous gear. Except during those times as the pinion is jogged by engagement with the mutilated gear, two adjacent pinion teeth of those which are axially extended ride the surface connecting the mutilated gear thereby to "lock" that pinion against movement. Adjacent pinions are similarly "locked" and there is no movement of the rotatable members except through a driving advance.

Other features and advantages of the present invention will become apparent as the specification continues.

DESCRIPTION OF THE PREFERRED EMBODIMENT

Figures 1, 5:
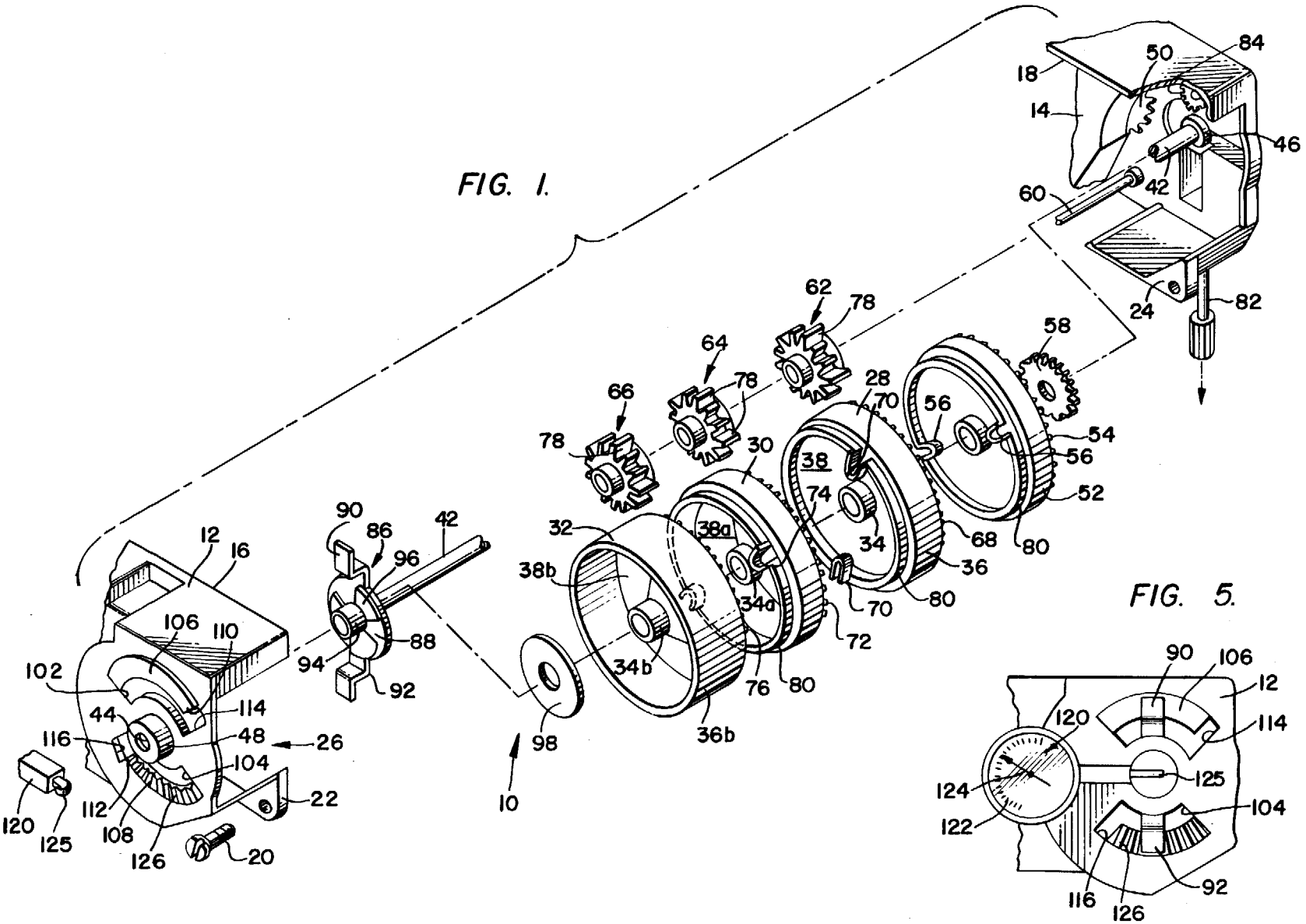
FIG. 1 is an exploded perspective view of the apparatus of the present invention with parts broken away for clarity.
FIG. 5 is a partial view of a portion of the apparatus of FIG. 1 and illustrates a guage for measuring the amount of endshake.
Figure 2:
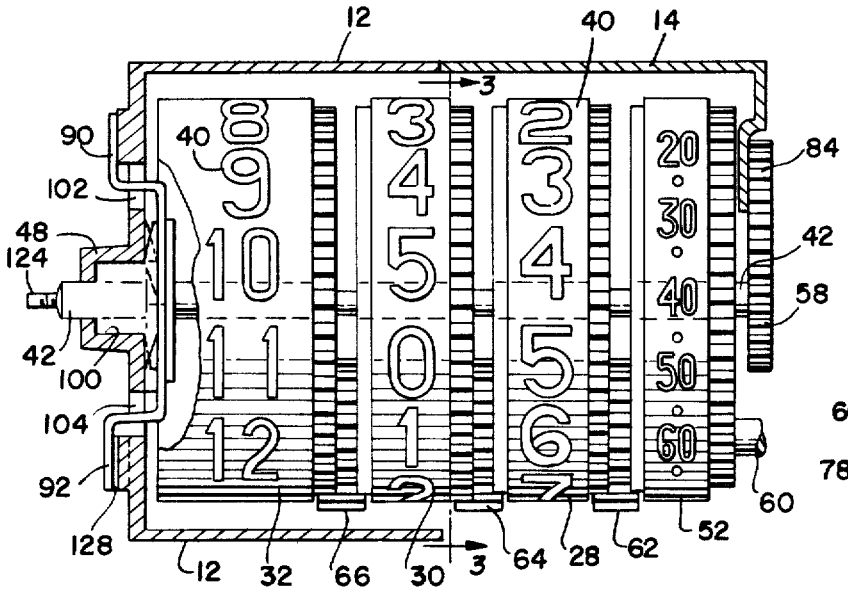
FIG. 2 is a front elevational view of a portion of the structure of FIG. 1.

The digital readout apparatus as heretofore generally described and particularly the adjustment structure and the structure both for timed advance and manual setting advance of an indicia presentation may be seen to advantage in FIGS. 1-4. In FIG. 1, a housing 10 for the digital readout apparatus is illustrated only to the extent deemed necessary in order to describe its capability both in the support of structure and in the manner by which there is cooperation with the adjustment structure in locating with clearance the rotatable members, hereinafter referred to as "indicia supporting members", relative one to the other.

The housing includes a pair of cooperative half-sections 12,14 which are engagable along surfaces 16, 18 and releasably secured by any one of a host of convenient fastening means. For example, the fastening means may comprise a number of screws 20, one of which is illustrated in position adapted to be received through ear portion 22 formed on one half-section for threaded receipt in a tapped hole in a cooperating ear portion 24 or the equivalent formed on the other half-section. The cooperating ear portions in the figure extend from the surfaces adjacent viewing window 26, while further cooperating ear portions (not shown) are carried at spaced locations around the perimeter of the half-sections 12, 14.

The indicia supporting members 28, 30 and 32 are each formed substantially similarly. To this end, the indicia supporting members are drum shape in outline and comprise a central hub 34, an outer surface 36 concentric with the axis of the central hub and a wall 38 connecting the outer surface and the central hub. The indicia supporting members 28, 30 and 32, more particularly their outer surface, provide support for units-of-minutes, tens-of-minutes, and hours indicia, respectively. The indicia may be heat stamped or by similar process applied directly to the outer surface or else applied to a tape or the equivalent which may be adhesively received on the outer surface. In the present form of the invention, numeric indicia is heat stamped as at locations 40 (see FIG. 2) on the outer surfaces. In the preferred embodiment, a single sequence of numerals 0–9 is carried by the units-of-minutes indicia supporting member, two sequences of numerals 0–5 are carried by the tens-of-minutes indicia supporting member, and a single sequence of numerals 1–12 is carried by the hour indicia supporting member. All of the numerals are of the same size, substantially. The numerals, however, are disposed at different spacing on the indicia supporting members, each of which is of the same diametrical size. As should be apparent, the axial dimension of the outer surface of the indicia supporting member 32 will be greater thereby to accommodate numerals including both units-of-minutes and tens-of-minutes. Also, the indicia will be of a color to contrast with the color of its support. Thus, the indicia may be white on a black or dark surface.

The display of numeric indicia presented at the viewing window 26 will change in accordance with the passage of time through operation of a timed mechanical advance or it can be changed rapidly through the manipulation of a manual advance mechanism. These operations will be described below.

A shaft 42 serves as a support for each of the indicia supporting members 28, 30 and 32. The shaft, in turn, is supported by the housing through receipt in a pair of apertures 44, 46. One aperture is located in one housing half-section within a boss 48; while the other aperture is located in similar disposition in the other housing half-section.

As indicated, the digital display at the viewing window 26 may be changed through both a timed and a setting advance which may be imparted manually. Irrespective of the input, i.e., whether it be a timed or manual input, movement of both indicia supporting members 30 and 32 is controlled by the movement of indicia supporting member 28.

Apparatus at the output of a mechanical drive train represented by gear 50, the input to which may derive from a motor or similar prime mover (not shown), serves to provide a timed advance of the digital display. The apparatus includes a member 52 having a ring gear 54 on one side surface and a mutilated gear 56 on the other side surface. The member 52, of a construction overall like that of indicia supporting members 28, 30 and 32 heretofore described, is a seconds indicia supporting member. A pair of ordered sequences of indicia including numerals in increments of 0, 10, 20 . . . 50 is carried on the peripheral surface again at locations 40 and similarly applied. The seconds indicia supporting member is mounted freely on the shaft and positioned axially by a pinion 58 at one end and a collar or the equivalent (not shown) spaced therefrom. Both the pinion and the collar or equivalent may be press fit or otherwise received on the shaft for this purpose.

When the shaft 42 is received by the half-sections 12, 14 of housing 10, as described, ring gear 54 on seconds indicia supporting member 52 will be in engagement with gear 50 thereby to be driven by the drive train. In the present embodiment, the seconds indicia supporting member is driven continuously at a speed of one-half revolution per minute.

The operation of the present digital readout is one wherein the indicia supporting members 28, 30 and 32 are indexed from one numeric presentation to another to change the display at window 26. The indexing operation, preferably, will be rapid to reduce the period of time that the indicia on each of the indicia supporting members 28, 30 and 32 is obscured by the housing. In the present embodiment, a complete revolution of seconds indicia supporting member 52 will result in indicia supporting member 28 indexing twice, although it should be apparent that the apparatus is capable of modification to accommodate any particular speed of rotation of the seconds indicia supporting member 52.

Figure 3:
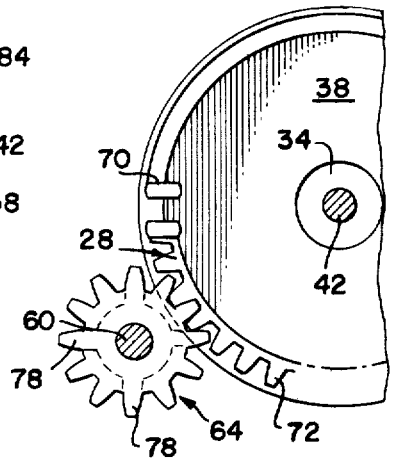
FIG. 3 is a view in vertical section along the line 3—3 in FIG. 2.
Figure 4:
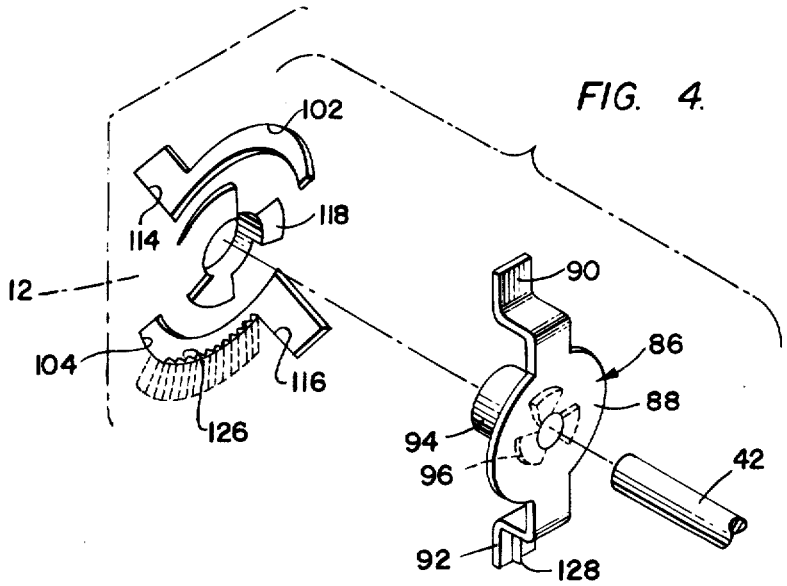
FIG. 4 is a perspective view illustrating the intercooperation of a pair of cam members.

The manner of indexing an indicia supporting member of higher order by an indicia supporting member of lower order may be seen in FIG. 3, a figure which may be considered representative of a drive between respective pairs of indicia supporting members. For example, then, the figure illustrates the seconds indicia supporting member 52 and the units-of-minutes indicia supporting member, which is driven thereby.

As set out, seconds indicia supporting member 52 carries a ring gear 54 on one surface and a mutilated gear 56 on the opposite surface. Actually, however, seconds indicia supporting member 52 because of its speed of rotation carries a pair of mutilated gears substantially diametrically opposed and each providing a driving input to indicia supporting member 28 when the seconds indicia supporting member shall have rotated through approximately one-half of a turn.

A shaft 60 is disposed parallel to shaft 42 and adjacent to the surfaces 36, **36*a* and 36*b* of indicia supporting members 28, 30 and 32. The shaft 60, likewise, is supported at its ends in the half-sections 12, 14 of housing 10. A plurality of pinions 62, 64 and 66 are carried by the shaft for engagement with a mutilated gear on one indicia supporting member and a ring gear on an adjacent indicia supporting member. To this end, the pinion 62 is in engagement with the mutilated gear 56 and a ring gear 68 on indicia supporting member 28; the pinion 64 is in engagement with a mutilated gear 70, also on indicia supporting member 28, and a ring gear 72 on indicia supporting member 30; and pinion 66 is in engagement with a mutilated gear 64, also on indicia supporting member 30, and a ring gear 66 on indicia supporting member 32**.

The drive of each of the indicia supporting members 30 and 32 is carried out similarly to that of indicia supporting member 28 and by similar structure. Each of the pinions 62, 64 and 66 are formed in a manner that a plurality of equidistantly spaced teeth are extended axially thereby to span between the ring gear on an indicia supporting member of higher order and the mutilated gear on an indicia supporting member of lower order, such as the indicia supporting members 28 and 52, respectively. In the present embodiment, the axially extended teeth 78 of the several pinions are located at 90° spacing and are jogged at particular increments of time by the mutilated gear upon each full or partial revolution. The pinion, in turn, jogs the ring gear through a stepped advance to change the numeric presentation. After each index consecutive ones of the axially extended teeth 78 reside in contact with a surface 80 connecting one side of the mutilated gear to the other or connecting mutilated gears, such as the gears 56, while the normal teeth reside in engagement with the ring gear, such as gear 68. The surface 80 prevents movement of the pinion until it shall be jogged or driven by a stepped increment.

Manual setting advance to the indicia supporting members is carried out in a similar manner except that the input to indicia supporting member 28 is through rotation of pinion 58 through manipulation of any convenient adjustment structure, illustrated generally by the stem 82. The stem may be biased in one direction and moved in the direction of the arrow for purposes of engaging drivingly a gear (not shown) with gear 84 rotationally supported by half-section 14 of housing 10. As may be seen in FIG. 2, gear 84 is engaged by pinion 58. Both pinion 58 and indicia supporting member 28 are fixed to shaft 42 by an appropriate means thereby to permit rapid setting of indicia supporting members 28, 30 and 32 by rotating stem 82 when in a position denoted by the arrow (FIG. 1).

An important aspect of the invention resides in the manner of adjustment of the axial positioning of indicia supporting members 30 and 32 relative to indicia supporting member 28 and the maintenance of a desired clearance therebetween. For this purpose, referring to FIG. 1, for example, the invention includes an endshake element 86 having a central plate-like body portion 88, a pair of arms 90, 92 extending oppositely from the body portion, a hub 94 disposed axially thereof and a group of cams 96 arranged around the hub. The endshake element and a washer 98 are received on shaft 42 between the inner surface of the half-section 12 of housing 10 and indicia supporting member 32.

As indicated, the shaft 42 is supported within a pair of apertures 44, 46, the aperture 44 being formed in the boss 48 which, also, is recessed at 100. The recess provides a bearing support for hub 94 of the endshake element.

As illustrated to advantage in FIG. 1, half-section 12 of housing 10 includes a pair of arcuate cutouts 102, 104 disposed symmetrically around boss 48. A raised surface 106, 108 concentrically outward of the cutouts includes an inclined surface or cam 110, 112 at the respective ends adjacent a pair of diametrically disposed notches 114, 116 connecting with the cutouts.

Upon assembly, the arms 90, 92 of the endshake element 86, both of which are substantially L-shaped, are received through the notches and cammed by the inclined surfaces onto the raised surfaces for angular adjusting movement of the endshake element between limits determined by the length of the cutouts.

A second plurality of cams 118 (see FIG. 4), like the cams 96, are provided on the half-section 12 around the recess 100. In operation, i.e., upon angular adjustment of the endshake element, the cams 96 will ride on the cams 118 of housing 10 thereby to move the endshake element axially toward the right in the figures. Thus, the endshake element will be moved from a position wherein there is maximum clearance between the indicia supporting members 28, 30 and 32 to a position wherein there is minimum clearance between these indicia supporting members.

A gauge 120 (FIG. 5) is supported by a bench fixture (not shown) for purposes of measuring the amount of clearance between the indicia supporting members. The full particulars of operation of the gauge are outside the scope of the present invention and, therefore, it will be described only generally. To this end, the gauge includes a dial 122 with a needle 124 pivotally movable between limits and an operator for the needle which is disposed so as to be engaged by an end of shaft 42 if the shaft be moved axially. The bench fixture, also, will receive the housing 10 in a manner that the operator 125 is closely adjacent the boss 48 and the shaft supported thereby. When the indicia supporting members are located in a position of minimum clearance, when the endshake element shall have been moved to the counterclockwise limit (FIG. 1) so that the cams 96 have moved fully on cams 118, axial movement of the shaft may be totally prevented or else the shaft may be capable only of minimal movement. The operator 125 is positioned to respond to any movement of the shaft 42, be it a movement through a distance of a few thousands of an inch or less, which is translated to a deflection of needle 124 which may be read on the dial 122 of gauge 120.

It is important to provide a clearance between the indicia supporting members without that clearance being excessive. It is also important that the clearance be adjustable since changes in ambient conditions may result in tolerance build-up in the parts because of their construction. The adjustment of the clearance between indicia supporting members in the present combination including the endshake element is carried out with relative ease and in a relatively inexpensive manner which is important, particularly when the total structure, i.e., the readout apparatus, may have application of only secondary importance as an accessory in an automobile. But importantly, the endshake element permits an adjustment of components for maintenance of capability of positive operation irrespective of conditions.

By provision of a series of radial serrations 126 on the raised surface 108 and a detent 128 on arm 92, the endshake element may be releasably located in a number of set positions of angular adjustment.

The endshake element preferably is formed of plastic material having a degree of resilience or flexibility to permit the carrying out of the functions as described. Other structures, such as the housing, gears of the drive train, pinions, etc. may be formed of a metal alloy or one of the many plastics as are commonly used in devices of this general type. And, while the drawing illustrates the gauge 120 supported in a manner that operator 125 is acted upon through movement of shaft 42 to the left, the bench fixture could also support the gauge to the right of housing 10 so that movement of shaft 42 in that direction would serve the same purpose.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. A digital readout apparatus including, in combination, a plurality of members carrying indicia representative of units-of-minutes, tens-of-minutes, and hours, respectively, arranged in ordered sequence, a shaft, housing means supporting said shaft and said shaft, in turn, supporting said members for rotation whereby a readout of time may be viewed at a window in said housing means, means limiting axial receipt of said member of lowest order toward one end of said shaft, means for indexing said member of lowest order, second and third means cooperating, respectively, between pairs of members including said member of lowest order for indexing a member of higher order by a member of lower order whereby the indicia presentation located to said window will be indicative of time, and means acting between said housing means and said hour member which is capable of selective adjustment to any one of a plurality of positions whereby through adjustment said hour member and the member of next lower order may be located within limits of adjustment on said shaft to vary the clearance between all members.

2. The apparatus of claim 1 wherein said means limiting axial receipt of said member of lowest order includes means for immovably locating the same on said shaft so that the member of lowest order and shaft rotate conjointly.

3. The apparatus of claim 2 including a pinion fixed on one end of said shaft, means carried by said housing adapted for engagement with said pinion thereby to rotate said member of lowest order independently of said indexing means through any amount of adjustment and, in turn, index each member of higher order for proper time adjustment.

4. The apparatus of claim 2 wherein each of the members is substantially the shape of a drum including a central hub portion through which said shaft is received.

5. The apparatus of claim 1 wherein said means for indexing said member of lowest order includes a fourth member adapted for continuous rotation, said fourth member having a continuous gear on one side adapted for engagement with a continuously driven gear and a mutilated gear on the other side, a pinion, and means for supporting said pinion for driven engagement with said mutilated gear at least upon each revolution of said fourth member.

6. The apparatus of claim 5 wherein said pinion is in driving engagement with a continuous gear carried by said member of lowest order and means for locking said pinion at all times except when drivingly engaged by said mutilated gear.

7. The apparatus of claim 6 wherein said locking means includes a surface within which said mutilated gear is formed and adjacent teeth of said pinion riding on said surface.

8. A digital readout apparatus including, in combination, a plurality of members carrying indicia representative of units-of-minutes, tens-of-minutes, and hours, respectively, arranged in ordered sequence, a shaft, housing means supporting said shaft and said shaft, in turn, supporting said members for rotation whereby a readout of time may be viewed at a window in said housing means, means limiting axial receipt of said member of lowest order toward one end of said shaft including means for immovably locating the same on said shaft so that the member of lowest order and shaft rotate conjointly, means for indexing said member of lowest order, second and third means cooperating, respectively, between pairs of members including said member of lowest order for indexing a member of higher order by a member of lower order whereby the indicia presentation located to said window will be indicative of time, and means acting between said housing means and said hour member whereby said hour member and the member of next lower order may be located within limits of adjustment on said shaft to vary the clearance between all members, said means being defined by an element including a plate portion having a central aperture, said element being received on said shaft for rotation therearound, cam means on one side of said plate cooperating with cam means on said housing, and at least an elongated arm carried by said plate and extending through a slot in said housing means for locating the position to which said element may be rotated.

9. The apparatus of claim 8 wherein said housing means includes a boss located axially of said means supporting said shaft, and said housing cam means being disposed adjacent said boss, said housing cam means cooperating with said cam means on said element for moving said element axially along said shaft through adjustment and varying the clearance between said member.

10. The apparatus of claim 9 wherein said housing means includes a pair of slots arranged symmetrically around said boss and said element including a pair of arms, one arm extending through each of said slots.

11. The apparatus of claim 10 wherein said housing means includes a pair of surfaces for supporting the ends of said arms which extend through said slots, one of said surfaces including a plurality of serrations, and one of said arms including a detent whereby said element may be located in one of a plurality of adjustable rotational positions as determined by the amount of clearance desired between said members.

12. A digital readout apparatus including, in combination, a plurality of members carrying indicia representative of units-of-minutes, tens-of-minutes, and hours, respectively, arranged in ordered sequence, a shaft, housing means supporting said shaft and said shaft, in turn, supporting said members for rotation whereby a readout of time may be viewed at a window in said housing means, means limiting axial receipt of said member of lowest order toward one end of said shaft, means for indexing said member of lowest order, second and third means cooperating, respectively, between pairs of members including said member of lowest order for indexing a member of higher order by a member of lower order whereby the indicia presentation located to said window will be indicative of time, and means acting between said housing means and said hour member which is capable of selective adjustment to any one of a plurality of positions between limits whereby through adjustment said hour member and all members of lower order may be located relative to one another on said shaft at and between positions of maximum and minimum spacing as determined by the position of the selective adjustment means.

* * * * *